US005118148A

United States Patent [19]

De Lima Castro Netto

[11] Patent Number: 5,118,148

[45] Date of Patent: Jun. 2, 1992

[54] LABEL HOLDER FOR CLOSING AND SEALING BAGS AND THE LIKE, AND SECURITY SEAL SUITABLE FOR USE THEREWITH

[75] Inventor: Eduardo De Lima Castro Netto, Rio de Janeiro, Brazil

[73] Assignee: ELC Produtos De Seguranca Industria E Comercio Ltda; Rio de Janeiro, Brazil

[21] Appl. No.: 589,006

[22] Filed: Sep. 27, 1990

[30] Foreign Application Priority Data

Oct. 11, 1989 [BR] Brazil ..... PI 8905160[U]

[51] Int. Cl.[5] ..... B05D 33/34

[52] U.S. Cl. ..... 292/307 R; 292/320; 292/325

[58] Field of Search ..... 292/307 R, 318, 319, 292/320, 321-331; 24/16 PB

[56] References Cited

U.S. PATENT DOCUMENTS

| | | | |
|---|---|---|---|
| 2,411,115 | 11/1946 | Rifkin | 292/325 |
| 2,980,461 | 4/1961 | Brooks | 292/307 R |
| 3,157,421 | 11/1964 | Nierhaus | 292/319 |
| 4,001,957 | 1/1977 | de Lima Castro | 292/307 A |
| 4,106,801 | 8/1978 | De Lima Castro Neto | 292/307 R |
| 4,175,782 | 11/1979 | De Lima Castro Neto | 292/307 R |
| 4,197,982 | 4/1980 | De Lima Castro Netto | 292/307 R |
| 4,512,599 | 4/1985 | De Lima Castro Netto | 292/307 R |
| 4,818,002 | 4/1989 | De Lima Casto Netto | 292/320 |

FOREIGN PATENT DOCUMENTS

| | | | |
|---|---|---|---|
| 2043384 | 1/1979 | Fed. Rep. of Germany | 292/307 R |
| 987328 | 4/1951 | France | 292/325 |
| 2163707 | 3/1986 | United Kingdom | 292/318 |
| 2168654 | 6/1986 | United Kingdom | 292/320 |

*Primary Examiner*—Gary L. Smith
*Assistant Examiner*—Darnell M. Boucher

[57] ABSTRACT

Label holders used for closing and sealing bags have the disadvantage of having to be individualized (numbered) since one type of violation would be destroying the label holder to withdraw the security seal intact and then substituting it with a new label holder and re-using the seal.

The label holder of this invention has two protuberances formed with rectangular openings on one portion thereof, which pass through two corresponding openings in the other portion when the label holder is closed. Two stops, one on each side of the strip of the outer surface between the two corresponding openings are provided. The security seal has a capsule and a lock interconnected by a thread, which in the sealed configuration are separated by the first protuberance, a part of the lock passing through the opening in such protuberance and a head of the lock being locked within the capsule. The part of the lock is connected to the head by weakenings. A blade projecting from the capsule has a free end which passes through the opening in the other protuberance and is formed with a lateral projection which engages behind such protuberance.

11 Claims, 6 Drawing Sheets

LABEL HOLDER FOR CLOSING AND SEALING BAGS AND THE LIKE, AND SECURITY SEAL SUITABLE FOR USE THEREWITH

Label holders for closing and sealing bags are known and, in particular, U.S. Pat. Nos. 4,106,801 and 4,175,782 are two good examples thereof. The device disclosed in U.S. Pat. No. 4,175,782 uses the sealing system of U.S. Pat. No. 4,106,801 and the contents of these two patents should be considered as incorporated herein by way of reference.

The basic principle of the label holders of the types described in the above mentioned patents is that a cord comes out from the interior of the label holder, is passed tightly around the neck of the bag and then terminates, at its other end, inside the label holder. Both ends of the cord and the label itself are closed within the label holder which then sealed to prevent access to the ends of the cord.

The label holder itself comprises a single part of plastics material in the form of two portions connected to each other along end edges by means of a plastic hinge (in reality, a region of reduced thickness) so that one portion may be folded over the other with the label positioned between the two. The bag closing system including the manner of fixing the ends of the cord will not be described at this moment since it is not relevant to the present invention. The sealing system, however, is of importance and, although shown in detail in the above mentioned patents and more specifically in Brazilian patent PI 7501943, it will now be described with respect to those aspects that are germane to the present invention.

In the case of U.S. Pat. No. 4,175,782 which uses the sealing system of U.S. Pat. No. 4,106,801, the outer surface of the upper portion of the label holder is formed with a protuberance that is hollow on its under side to define a cavity the bottom of which is closed by the inner (upper) surface of the lower portion of the label holder when in its closed configuration. One wall of the cavity, which is upstanding from the outer surface of the upper portion of the label holder, is formed with a rectangular opening the major dimension of which is parallel to such surface so as to give sideways access from the outside to the interior of the cavity. At the same time, the inner wall of the lower portion of the label holder has a protuberance in the form of a small wall having formed therein an opening with dimensions identical to those of the previously mentioned opening and positioned so that, on closure of the label holder, the small wall is within the cavity and flush with the inner surface of the other wall with an opening, the two openings being aligned with each other. The label holder can then be sealed by means of an arrow head type seal that is introduced under pressure through the two openings so that the head of the seal becomes locked within the cavity with the arms or barbs caught behind and laterally of the opening in the small wall. The head of the seal is joined by points of weakening to a base including a numbered blade that extends out of the cavity. In the sealed position, the points of weakening are positioned between the two rectangular openings, that is to say, between the two portions of the label holder, so that, on breaking the points of weakening, the separated head of the seal remains within the cavity and the label holder may be opened.

Although this label holder sealing system has been widely accepted by security carriers, it has the following two disadvantages:

a) bearing in mind that the security of the system against violation depends on the integrity of the numbered seal, it would be easy to make an undetectable violation by destroying the label holder itself so as to remove the seal intact. It would then only be necessary to substitute the label holder, reclose the bag and seal the substituted label holder with the same seal. In order to prevent this type of violation, it is necessary to individualize (number) each label holder, which makes it necessary to note down the number of the label holder as well as that of the seal, and b) closure and sealing of the label holder are effected substantially at a single point (the position of the cavity) of the width thereof. Since the label holder is relatively wide and flexible, there is the possibility of deforming the label holder at a point remote from that where sealing is effected and in this way obtain access to the label or even the points of fixture of the cord that closes the bag.

An object of the present invention is to provide a label holder for closing and sealing bags and the like which enjoys all the advantages of the prior art label holders without the above mentioned disadvantages.

Another object of the invention is to provide a seal suitable for use with such a label holder.

According to the present invention, a label holder for the closure and sealing of bags and the like, comprising first and second generally planar portions of subtantially corresponding shapes, each of said portions having first and second opposite edges, third and fourth opposite edges, an outer surface and an inner surface, a hinge interconnecting said first edges so that the second portion may be folded over said first portion to a closed configuration of the label holder with said inner surfaces facing each other, means for permitting the fixture of the ends of a length of cord within the interior of the label holder when in the closed configuration and means permitting the closure and sealing of the label holder in said closed configuration, said means for permitting the closure and sealing of the label holder comprising:

a) a first protuberance formed on said inner surface of said first portion adjacent a corner thereof defined by the meeting of said second and third edges of the first portion, said first protuberance having formed therein a first substantially rectangular opening;

b) a second protuberance formed on said inner surface of said first portion adjacent a corner thereof defined by the meeting of said second and fourth edges of the first portion, said second protuberance having formed therein a second substantially rectangular opening the axis of which is directed substantially in the direction of the first protuberance;

c) third and fourth openings formed through said second portion is correspondence with the respective said first and second protuberances so that, in said closed configuration of the label holder, said first and second protuberances pass through said third and fourth openings to protect beyond said outer surface of said second portion; and d) a third protuberance formed from the outer surface of the second portion, positioned between said third and fourth openings, closer to said fourth opening and laterally of said second opening in the closed configuration of the label holder, said third protuberance being provided with a stop surface parallel to and facing said outer surface of said second portion at a height corresponding to the upper limit of said second opening in the closed configuration of the label holder, and extended at least partially through the width of said second opening but displaced therefrom towards said third opening.

Preferably there is also a fourth protuberance on the outer surface of the second portion, having a stop surface substantially normal to said outer surface and located between the third protuberance and the third opening but, in the closed configuration of the label holder with the stop surface substantially alined with the other side of the second opening with respect to the third protuberance.

A label holder having the above features may be closed and sealed by means of a security seal, also in accordance with the present invention, in such a way that there is no longer any necessity to personalize the label holder whilst, at the same time, ensuring an even higher degree of security than can be obtained using the label holders and seals of the prior art.

A security seal according to the invention, which may be used for sealing the label holder defined above when in the closed configuration, comprises a locking part, a capsule part for receiving a head of the locking part so that the latter cannot be removed, a permanent flexible connection between the locking part and the capsule part and a blade integral with one of such parts, the locking part having a base connected to the remaining portion of the locking part by weakening means and said blade having a free end formed with a lateral projection in the plane of the blade.

A brick shaped base portion of the locking part is dimensioned to fill substantially all of the first opening in the first portion of the label holder when in the closed configuration. Thus, when the head of the locking part is inserted first through the first opening and then into the capsule, the weakening means will be situated between the first protuberance and the capsule part. With the seal closed in this manner, the base of the locking part in the interior of the first opening will prevent opening of the label holder whereas, on breaking the weakening means, opening may be effected.

At the same time that one places the seal in position to seal the arrangement, the free end of the blade is passed through the second opening in the second protuberance with its lateral projection facing the opposite side to that of the fourth protuberance which, in turn, presents its stop surface to the upper surface of the blade, preventing the latter from being raised. Consequently, the end of the blade in the second opening also prevents the opening of the label holder.

In other words, the system effectively seals the label holder at two points adjacent its two opposite edges and not only at one point as in the prior art.

The present invention will be better understood from the following description given by way of example with reference to the accompanying drawings, in which.

Figure 1:
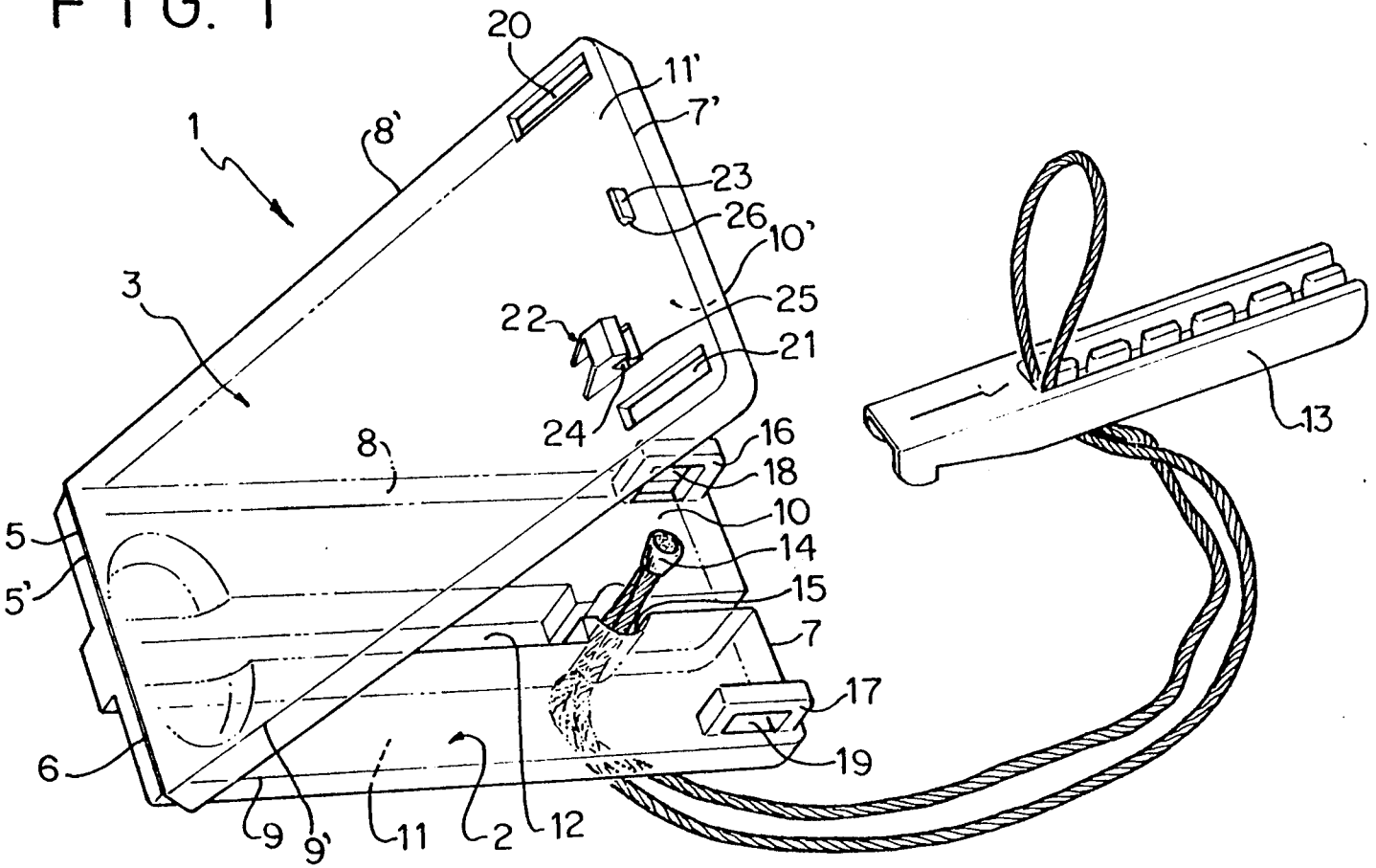
FIG. 1 is a perspective view of a label holder made in accordance with the present invention.
Figure 2:
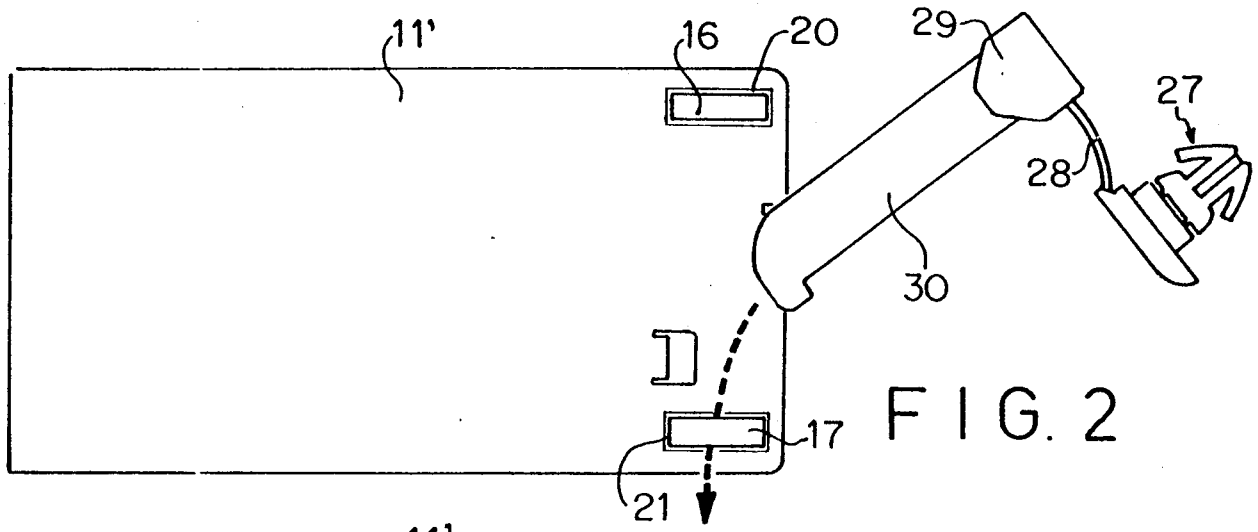
FIG. 2 is a plan view of the label holder of FIG. 1 in the closed configuration and with a security seal, also in accordance with the invention, ready for sealing the arrangement.
Figure 3:
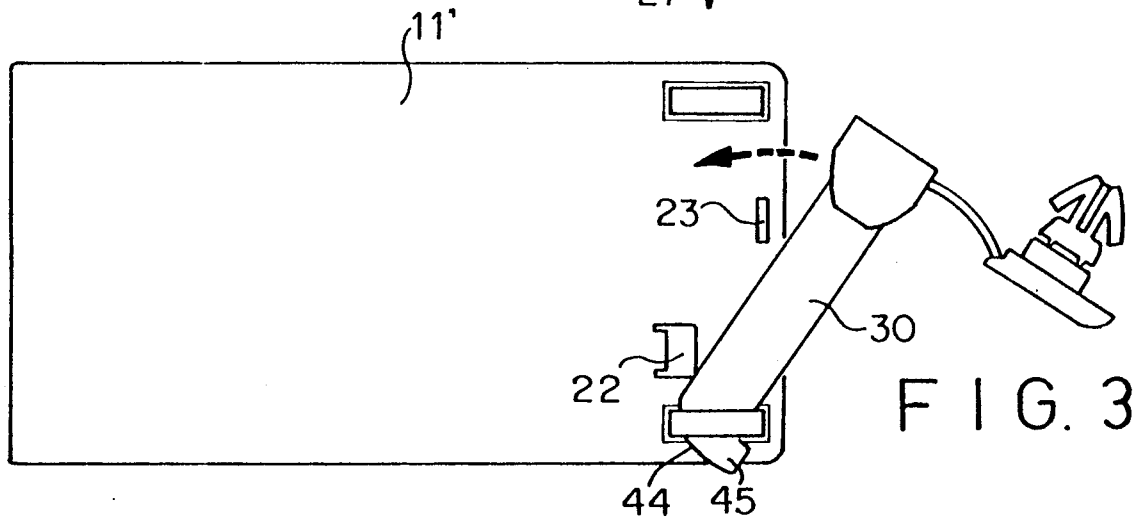
FIG. 3 is a view similar to that of FIG. 2, but with the seal in an intermediate phase of insertion.

Referring now to the drawings which show presently preferred embodiments of the label holder and seal of the present invention, FIG. 1 shows in perspective a label holder 1 comprising first and second portions 2 and 3 which are substantially rectangular and of the same shape when seen in plan, and which are connected to each other at first end edges 5 and 5' by means of a hinge 6. Both portions 2 and 3 and hinge 6 comprise a single piece of plastic material, preferably polypropylene.

Portions 2 and 3 also have second end edges 7 and 7', opposite to first edges 5 and 5', third and fourth opposite side edges 8, 8' and 9, 9', inner surfaces 10 and 10' and outer surfaces 11 and 11'.

The label holder 1 is generally similar to that disclosed and illustrated in U.S. Pat. No. 4,175,782 in that edges 7', 8' and 9' of portion 3 are flanged so as to receive portion 2 therebetween when folded about hinge 6 to assume a closed configuration. Apart from this, portion 2 of the label holder is formed with an elongated cavity 12 to receive a lever 13 to which one end of a length of cords may be fixed, the other end of the cord being provided with a stop or fixing means 14 which engages the interior of a cylindrical cavity 15 in portion 2. In view of the fact that they correspond and to all effects and purposes are identical to those of U.S. Pat. No. 4,175,782 and also are not relevant to the new concept of the present invention, the features related to the lever and cord will not be described herein in any greater detail.

Figure 6:
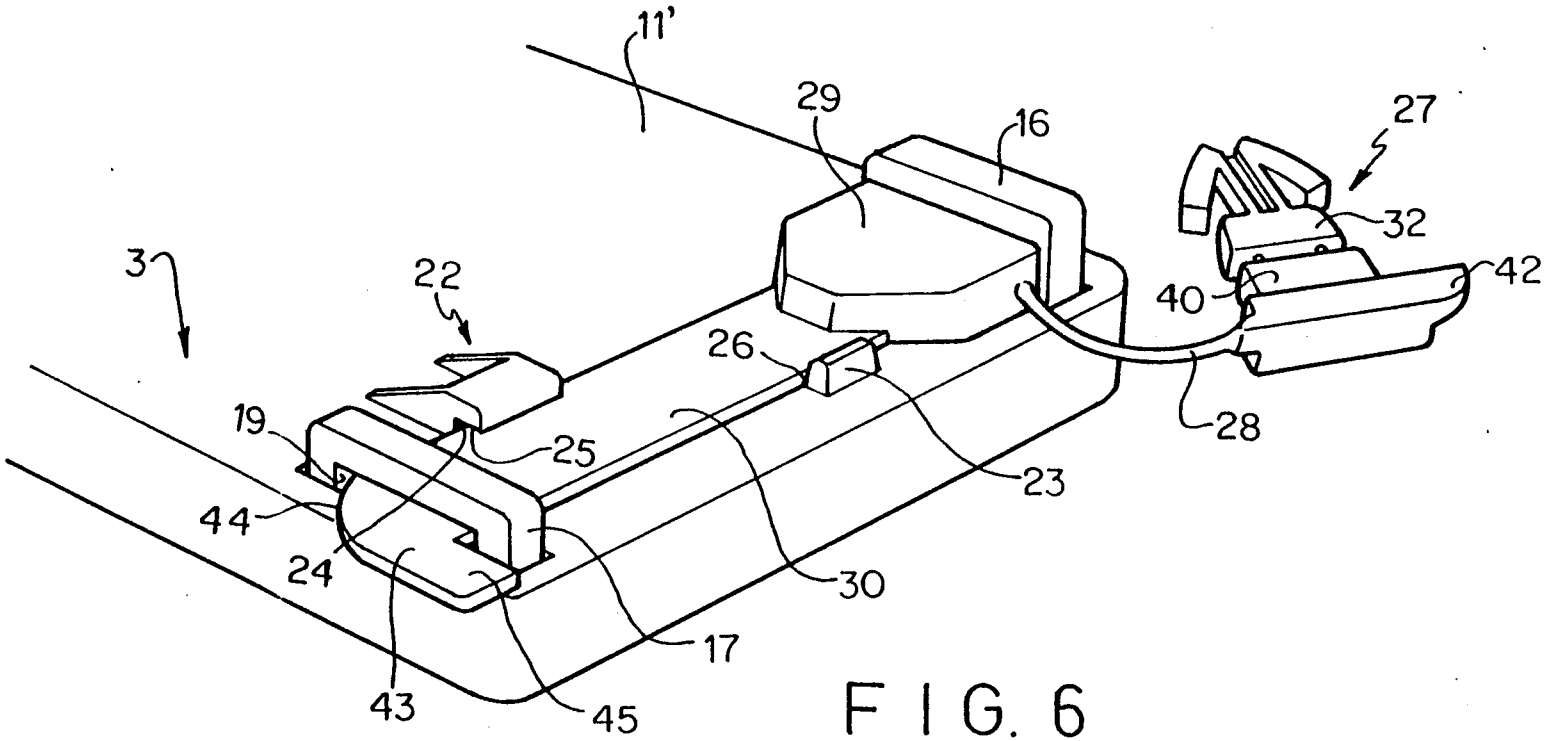
FIG. 6 is a perspective view of one end of the label holder in a closed configuration similar to that shown in FIG. 4.
Figure 7:
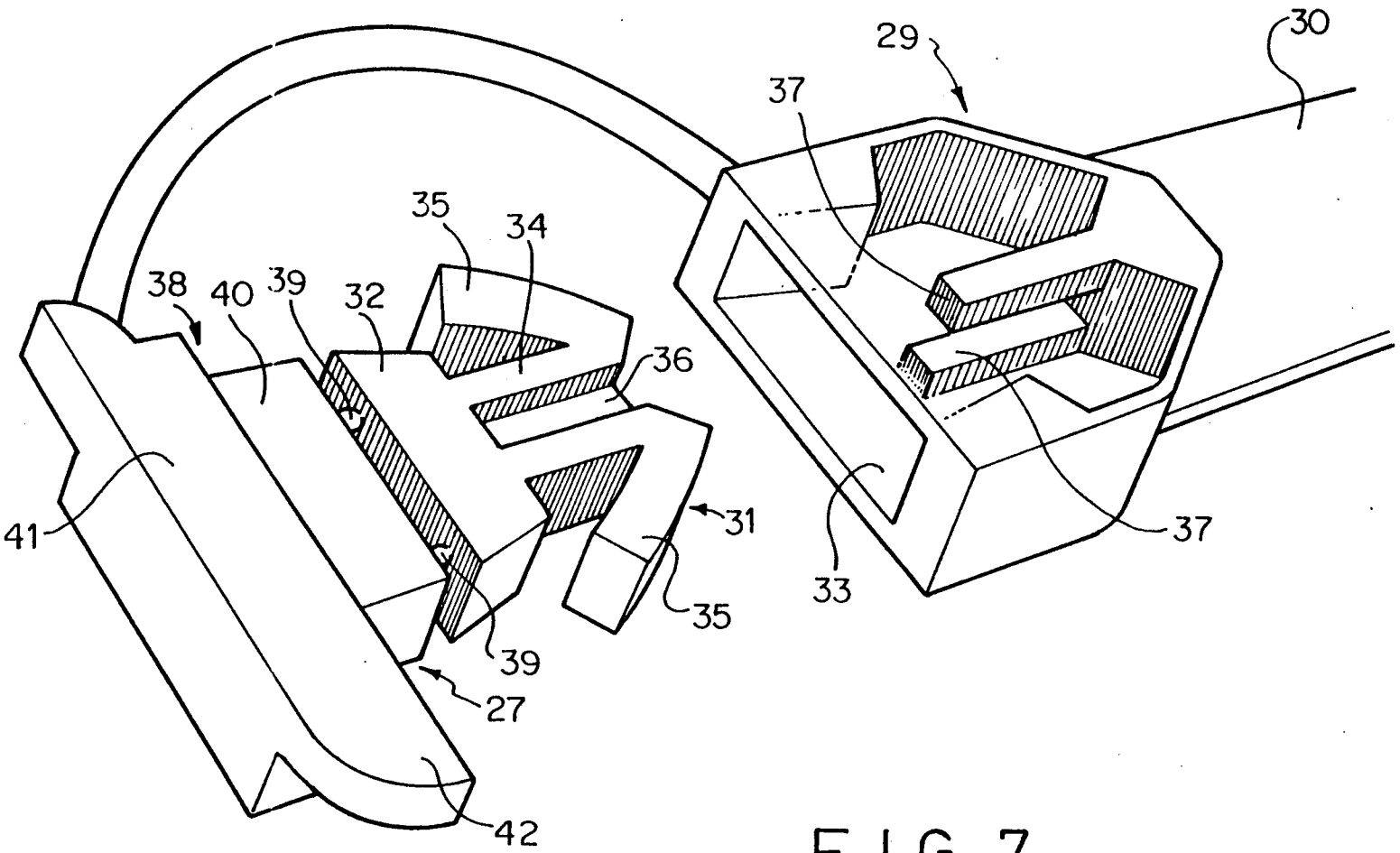
FIG. 7 is a detailed perspective view of the seal with the capsule open to show its interior.

According to the present invention, portion 2 is formed with first and second protuberances 16 and 17 in the form of walls formed with first and second alined rectangular openings 18 and 19. Protuberances 16 and 17 are located adjacent the second end edge 7 at the corners with the third and fourth side edges 8 and 9, their axes being parallel to edge 7. As best seen in FIG. 6, protuberance 16 and its opening 18 have dimensions normal to the inner surface 10 of portion 2, that is to say, heights, that are greater than those of protuberance 17.

Portion 3 of the label holder is formed with third and fourth rectangular openings 20 and 21 corresponding to protuberances 16 and 17 in portion 2 so that, on folding portion 3 over portion 2, the protuberances will pass through openings 20 and 21 to project beyond outer surface 11' of portion 3. This is best seen in FIG. 6.

Outer surface 11' of portion 3 is formed with two stops in the form of third and fourth protuberances 22 and 23, both between openings 20 and 21 but on opposite sides of the strip of surface 11' that runs between them. Protuberance 22 which is nearer to opening 21, has the appearance of a small hook defining a lateral stop surface 24 and an upper stop surface 25 parallel to and facing surface 11' at a height substantially equal to the height of that part of the second opening 19 that projects beyond surface 11'. The other protuberance 23, nearer to opening 20, has the appearance of a small tooth and has a lateral stop surface 26. The two lateral stop surfaces 24 and 26 are located at opposite edges of the strip of surface 11' running between aligned openings 20 and 21. All this may be seen clearly in the drawings and especially in FIGS. 1 and 6.

FIGS. 2 to 5 show a security seal 26 manufactured in accordance with this invention and specially adapted for use in sealing the label holder 1. Seal 26 comprises a locking part 27 connected by a thread 28 to a capsule part 29 behind which projects a blade 30.

The locking part 27 has an arrow type head 31 comprising a solid base 32 for filling an entrance 33 to the capsule part 29, a central portion 34 designed to penetrate the interior of the capsule part, projecting from the centre of the base 32, and two flexible arms or barbs 35 which extend outwardly and backwardly towards the base from the free end of central portion 34. There are two lateral shoulders within the capsule part 29, one on each side of opening 33, serving as stops for the free ends of the arms 35. When head 31 is introduced into capsule part 29, flexible arms 32 are deformed elastically as they pass through opening 33 and then return to their original configuration within the capsule part, with the free ends of the arms caught behind the lateral shoulders and with the base 32 filling opening 33. With a view to increase the degree of security of the seal so as to make it impossible to withdraw head 31 from the interior of capsule part 29, central portion 34 is formed with central longitudinal grooves, one on each side thereof, for receiving two corresponding ribs 37 formed within the capsule part 29. These fitments positively prevent any attempt at violation by rotating the head 31 slightly so as to facilitate access to the ends of arms 32 in an attempt to free them from the locking shoulders inside the capsule part.

Locking part 27 is further provided with a base 38 connected to base 32 of head 31, by means of two weakening bridges 39. Base 38 comprises a brick shaped portion 40 having dimensions substantially equal to those of that part of the first opening 18 that projects beyond portion 3 of the label holder in the closed configuration thereof (see FIG. 6). Base 38 further comprises a second portion 41 having dimensions greater than said part of opening 18 so as to abut the first protuberance 16 in the sealed configuration (see FIG. 5). One side of portion 41 is integral with the thread 28 which connects locking part 27 to the capsule part 29 while its other side is formed with a lateral tooth 42 to be used when authorized opening of the label holder is to be effected, as will be described later.

Blade 30 which extends from the end of capsule part 29, opposite to that of entrance 33, has a free end 43 with one rounded edge 44 and its other side in the form of a lateral protuberance or hook 45 in the same plane as the rest of the blade. As can be seen from FIGS. 3 to 6, the sum of the lengths of the capsule part 29 and of the blade 30 is such that, when the seal is applied to the label holder in position for closure, the capsule part is placed flush against the first protuberance 16 and the blade passes through opening 19 in the second protuberance behind which lateral hook 45 is then caught.

As shown in the drawings, blade 30 is preferably individualized, for example, by numbering which in its turn and in the interests of security is effected in high relief.

In use of the label holder, lever 13 with the cord is passed around the neck of the bag to be closed and then manipulated so as to be extended along cavity 12 in portion 2 of the label holder and, to tighten the cord, precisely as described and illustrated in U.S. Pat. No. 4,175,782. A label indicating the destination of the bag is then placed over the inner surface 10 of portion 2 and portion 3 is closed over part 2 so that protuberances 16 and 18 extend upwardly through openings 20 and 21, respectively, as shown in plan in FIG. 2.

Figure 4:
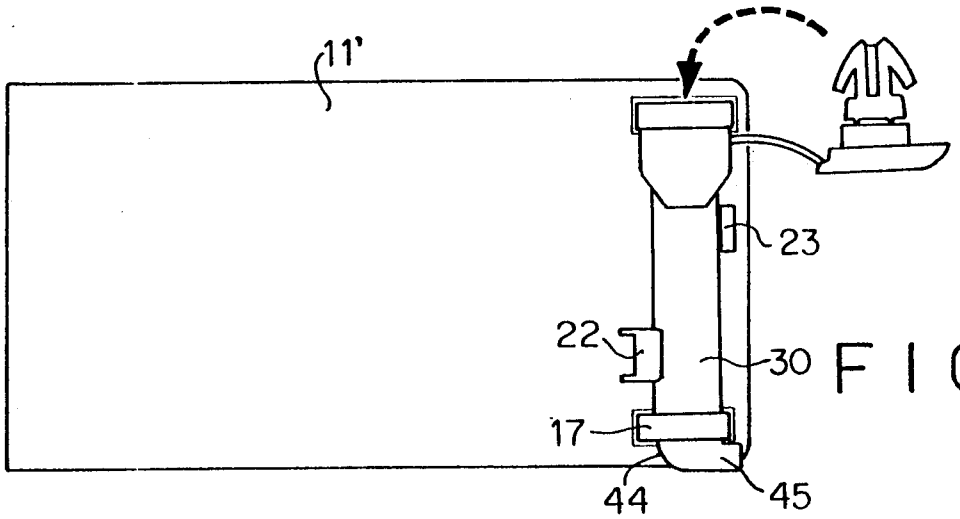
FIG. 4 is a view similar to that of FIG. 3, but with the seal completely inserted and ready for closure.

FIGS. 2 to 5 show the sequence of applying and closing the seal 1 used to seal the label holder and consequently the bag itself. The indicative arrows in FIGS. 2 to 5 facilitate understanding. Firstly (FIG. 3), lateral hook 45 of blade 30 is introduced through opening 21 in protuberance 17, the rounded side 44 facilitating this. At the same time, the capsule part 29 is raised slightly so that blade 30 can pass above protuberance or stop 23 the edge of the blade corresponding to rounded side 44 passes below stop surface 25 on the other protuberance 22 on the outer surface 11' of portion 3 of the label holder. The seal is then rotated slightly so that blade 30 and capsule part 29 become aligned with the two protuberances 16 and 17, as illustrated in FIG. 4. It will be observed that in such position the blade is caught by hook 43 behind protuberance 17, impeded from lifting due to it passing below stop surface 25 of protuberance 22 and locked against longitudinal displacements by being fitted between stop 23 and lateral stop surface 24 of protuberance 22. Thus, when the capsule part 29 is locked in the position shown in FIGS. 4, 5 and 6, end 41 of blade 30 cannot be withdrawn from opening 21 and consequently the label holder is locked against opening on the side of protuberance 17.

Figure 5:
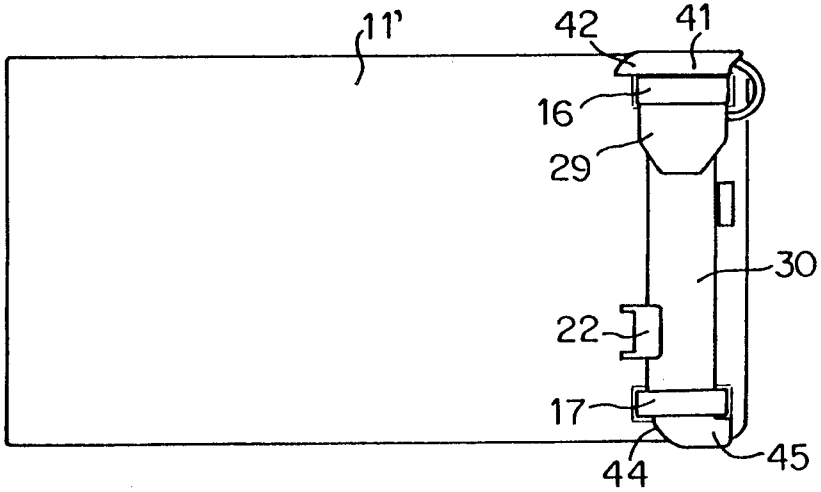
FIG. 5 is a view similar to that of FIG. 4, but with the seal closed and the label holder sealed.

Final sealing is effected by passing from the configuration shown in FIG. 4 to that illustrated in FIG. 5, this envolving the insertion of head 31 of the locking part 27 through opening 18 in protuberance 16 and into the capsule part 29. Once head 31 is inserted, seal 1 locks and this maintains protuberance 16 between portion 1 of the base of the locking part and the capsule part 29, the weakening bridges 39 being positioned substantially in a small gap existing between protuberance 16 and the capsule part. Obviously, the dimensions of capsule part 29 are such that it cannot pass through opening 18.

The only manner of removing the seal from the system without damaging it would be the total destruction of the label holder containing the protuberances 16 and 17. This, however, would not in any way help the violator since, when substituting the label holder for another identical one, the individualized seal would still be closed and there would be no way of using it to seal the new label holder. As a consequence, the security of the system would not be affected by individualizing the label holder or not.

Authorized opening of the label holder 1 is extremely simple, it being sufficient to place a finger behind tooth 42 and to force the locking part off by breaking the weakening bridges 39. The capsule part with the blade can then be removed and the label holder is free for opening.

Finally, it should be observed that protuberance 16 is slightly higher than protuberance 17 simply due to the fact that the base 32 of head 31 of the seal, which has to occupy the interior of opening 18, is thicker than the blade 30 that passes through opening 19.

It will be understood that a number of variations or modifications may be made within the basic concept of the invention. For example, protuberance 22 does not have to be hook shaped. It could be substituted by a part forming a tunnel for the seal blade, which would be wider than the latter so as to permit manipulation during application. The essential is that the protuberance in question prevents lifting of the blade after the seal has been closed.

Figure 8:
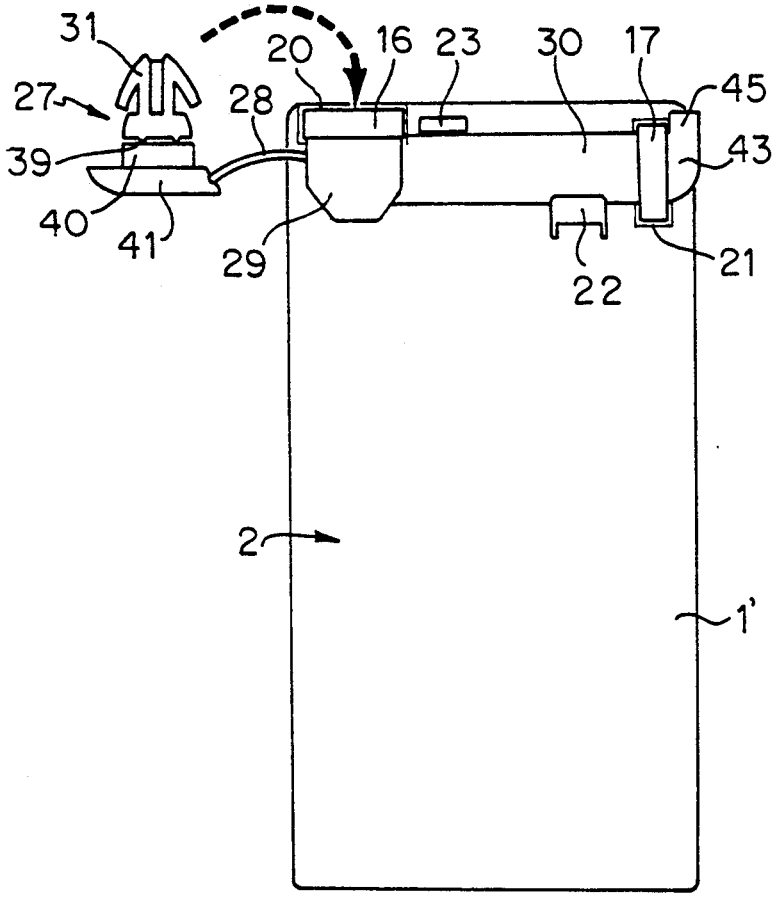
FIG. 8 is a view similar to that of FIG. 4, but showing a second embodiment.

Apart from this, it is not even necessary for openings 18 and 19 in protuberances 16 and 17 to be aligned with each other provided that the seal 26 be modified slightly. A second embodiment of the invention incorporating such a modification is shown in FIG. 8 in which the same reference numbers as in FIGS. 1 to 7 have been used. In this second embodiment the second protuberance 17 in portion 2 of the label holder and opening 21 in the second portion 3 of the label holder have not been modified as also there is no change in stops 22 and 23. Protuberance 16 and opening 20, however, are positioned at right angles to the arrangement of the first embodiment and, as a result, the seal has been altered so that the blade 30 projects laterally from capsule part 29. All this is clearly shown in FIG. 8 and it will be understood that the arrangement of the sealing system is totally equivalent—as regards function—to that of the first embodiment.

The scope of the invention should therefore be limited only in accordance with the terms of the following claims.

I claim:

1. Label holder for the closure and sealing of bags, comprising first and second generally planar portions of substantially corresponding shapes, each of said portions having first and second opposite edges, third and fourth opposite edges, an outer surface and an inner surface, a hinge interconnecting said first edges so that said second portion may be doubled over said first portion to a closed configuration of the label holder with said inner surfaces facing each other, means for permitting the fixture of the ends of a length of cord within the interior of said label holder when in the closed configuration and means permitting the closure and sealing of the label holder in said closed configuration, said means for permitting the closure and sealing of the label holder comprising:

a) a first protuberance formed on said inner surface of said first portion adjacent a corner thereof where said second and third edges of said first portion meet, said first protuberance being formed with a first substantially rectangular opening;

b) a second protuberance formed on said inner surface of said first portion adjacent a corner thereof where said second and fourth edges of the first portion meet, said second protuberance being formed with a second substantially rectangular opening directed substantially towards said first protuberance;

c) third and fourth openings formed through said second portion in correspondence with the respective said first and second protuberances so that, in said closed configuration of the label holder, said first and second protuberances pass through said third and fourth openings to project beyond said outer surface of said second portion; and d) a third protuberance formed on the outer surface of said second portion, positioned between said third and fourth openings, closer to said fourth opening and laterally of said second opening in the closed configuration of the label holder, said third protuberance being provided with a first stop surface parallel to and facing said outer surface of said second portion at a height corresponding to the upper limit of said second opening in the closed configuration of the label holder, and extended at least partially across the width of said second opening but displaced therefrom towards said third opening.

2. Label holder according to claim 1, in which said third protuberance is hook shaped having a second lateral stop surface substantially normal to said outer surface of the second portion and substantially aligned with one side of said second opening.

3. Label holder according to claim 1, further comprising, on said outer surface of said second portion, a fourth protuberance having a third lateral stop surface substantially normal to the outer surface of said second portion, the fourth protuberance being located between said third protuberance and said third opening but, in said closed configuration of the label holder, with said third stop surface substantially aligned with the side of said second opening that is opposite that associated with said third protuberance.

4. Label holder according to claim 3, in which said first protuberance and said first opening have heights greater than those of said second protuberance and of the said second opening.

5. Label holder according to claim 1, in which said first and second openings face and are aligned with each other.

6. Label holder according to claim 1, in which said first and second openings are at right angles to each other.

7. Security seal suitable for sealing a label holder in closed configuration, comprising a locking part, a capsule part for receiving through an entrance a head of said locking part so that the latter cannot be removed, a permanent flexible connection between said locking part and said capsule part and a blade integral with one of said parts, in which said locking part has a base connected to said head by weakening means and said blade has a free end formed with a lateral projection in the plane of said blade, said base of said locking part having a first portion of larger cross section remote from said weakening means and a second portion of smaller cross section, between said first portion and said weakening means.

8. Security seal according to claim 7, in which said head of the locking part comprises a base for substantially filling said entrance of said capsule part, a central part projecting centrally from said base and two flexible lateral arms extended outwardly and backwardly from a free end of said central part, said central part being formed with a longitudinal groove in two opposite faces thereof and the interior of said capsule part being formed with two ribs which enter said grooves when said head is totally inserted into said capsule part.

9. Security seal according to claim 7, in which said first part of said base of said locking part is formed with a lateral tooth.

10. Security seal according to claim 7, in which said blade is integral with said capsule part.

11. Label holder according to claim 1, sealed in said closed configuration by a security seal, said security seal including a locking part, a capsule part for receiving through an entrance a head of said locking part so that the latter cannot be removed, a permanent flexible connection between said locking part and said capsule part, and a blade integral with one of said parts, said locking part having a base connected to said head by weakening means, said blade having a free end formed with a lateral projection in the plane of said blade; said base of said locking part having a first portion of larger cross section remote from said weakening means, and a second portion of smaller cross section between said first portion and said weakening means, both said capsule part and said first portion of said base of said locking part of said seal being larger than said first opening in said label holder, and said second portion of said base being dimensioned substantially to fill said first opening, said head of said locking part being inserted into said capsule part after passing through said first opening, said blade having a free end passing through said second opening in said label holder with said lateral projection caught behind said second protuberance whilst one edge of said blade passes between said first stop surface and said outer surface of said second portion of the label holder.

* * * * *